US007160178B2

(12) United States Patent
Gagliardi et al.

(10) Patent No.: US 7,160,178 B2
(45) Date of Patent: Jan. 9, 2007

(54) IN SITU ACTIVATION OF A THREE-DIMENSIONAL FIXED ABRASIVE ARTICLE

(75) Inventors: John J. Gagliardi, Hudson, WI (US); Chris J. Rueb, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 74 days.

(21) Appl. No.: 10/636,792

(22) Filed: Aug. 7, 2003

(65) Prior Publication Data

US 2005/0032462 A1 Feb. 10, 2005

(51) Int. Cl.
*B24B 1/00* (2006.01)
*B24B 23/06* (2006.01)

(52) U.S. Cl. ..... 451/41; 451/312; 451/313

(58) Field of Classification Search ..... 451/41, 451/285–290, 495, 527–530, 313, 317
See application file for complete search history.

(56) References Cited

U.S. PATENT DOCUMENTS 907,862 A 12/1908 Nicholls
2,990,661 A 7/1961 Hackett
3,110,140 A 11/1963 Reames
4,652,275 A 3/1987 Bloecher et al.
4,799,939 A 1/1989 Bloecher et al.
5,014,468 A 5/1991 Ravipati et al.
5,152,917 A 10/1992 Pieper et al.
5,453,312 A 9/1995 Haas et al.
5,454,844 A 10/1995 Hibbard et al.
5,458,532 A 10/1995 Cannone
5,500,273 A 3/1996 Holmes et al.
5,531,635 A 7/1996 Mogi et al.
5,578,362 A 11/1996 Reinhardt et al.
5,692,950 A 12/1997 Rutherford et al.
5,820,450 A 10/1998 Calhoun
5,897,424 A 4/1999 Evans et al.
5,913,716 A * 6/1999 Mucci et al. ..... 451/59
5,958,794 A 9/1999 Bruxvoort et al.
6,093,085 A 7/2000 Yellitz et al.
6,093,280 A 7/2000 Kirchner et al.
6,123,612 A 9/2000 Goers
6,190,243 B1 2/2001 Wada et al.
6,194,317 B1 * 2/2001 Kaisaki et al. ..... 438/692
6,217,426 B1 4/2001 Tolles et al.
6,220,942 B1 4/2001 Tolles et al.
6,263,605 B1 7/2001 Vanell
6,312,319 B1 11/2001 Donohue et al.
6,325,702 B1 12/2001 Robinson
6,361,414 B1 * 3/2002 Ravkin et al. ..... 451/56

(Continued)

FOREIGN PATENT DOCUMENTS

FR 1 596 322 6/1970

(Continued)

OTHER PUBLICATIONS

Document: 3M SlurryFree™ CMP, Fixed Abrasives for Direct HDP STI CMP, Technical Brief 2003, J.J. Gagliardi, Jun. 2003.

(Continued)

*Primary Examiner*—M. Rachuba
(74) *Attorney, Agent, or Firm*—Thomas M. Spielbauer

(57) ABSTRACT

An apparatus including a fixed abrasive article interposed between a substrate and a support assembly. The support assembly creates regions of high and low erosion force at the interface between the substrate and the fixed abrasive article. The high erosion force is sufficient to activate the fixed abrasive article.

57 Claims, 3 Drawing Sheets

U.S. PATENT DOCUMENTS

| | | | | |
|---|---|---|---|---|
| 6,361,423 | B1 | 3/2002 | Gurusamy et al. | |
| 6,413,873 | B1 | 7/2002 | Li et al. | |
| 6,451,697 | B1 * | 9/2002 | Sun et al. | 438/691 |
| 6,491,843 | B1 | 12/2002 | Srinivasan et al. | |
| 6,498,101 | B1 | 12/2002 | Wang | |
| 6,508,697 | B1 | 1/2003 | Benner et al. | |
| 6,520,834 | B1 | 2/2003 | Marshall | |
| 6,524,167 | B1 * | 2/2003 | Tsai et al. | 451/41 |
| 6,530,824 | B1 * | 3/2003 | Thomas et al. | 451/41 |
| 6,569,349 | B1 * | 5/2003 | Wang et al. | 252/79.1 |
| 6,575,825 | B1 | 6/2003 | Tolles et al. | |
| 6,592,438 | B1 | 7/2003 | Tolles et al. | |
| 6,612,917 | B1 | 9/2003 | Bruxvoort | |
| 6,632,129 | B1 | 10/2003 | Goetz | |
| 6,648,731 | B1 | 11/2003 | Shin | |
| 6,712,679 | B1 * | 3/2004 | Taylor et al. | 451/303 |
| 2001/0005667 | A1 | 6/2001 | Tolles et al. | |
| 2001/0008830 | A1 | 7/2001 | Tolles et al. | |
| 2001/0014571 | A1 | 8/2001 | Robinson | |
| 2002/0077037 | A1 | 6/2002 | Tietz | |
| 2002/0106980 | A1 | 8/2002 | Bruxvoort | |
| 2002/0111120 | A1 | 8/2002 | Goetz | |
| 2002/0142601 | A1 | 10/2002 | Boyd et al. | |
| 2003/0022598 | A1 | 1/2003 | Muilenburg et al. | |
| 2003/0027504 | A1 | 2/2003 | Shipley et al. | |
| 2003/0032379 | A1 | 2/2003 | Taylor et al. | |
| 2004/0053566 | A1 | 3/2004 | Tolles et al. | |
| 2004/0072518 | A1 | 4/2004 | Prabhu et al. | |

FOREIGN PATENT DOCUMENTS

| | | | |
|---|---|---|---|
| WO | WO 02/28596 | A1 | 4/2002 |
| WO | WO 03/058691 | A1 | 7/2003 |

OTHER PUBLICATIONS

Product Literature: Letter re "Max-Grip Da Hook Pad," Plymouth Products, Dec. 1, 2000, 2 pages.
Product Literature: Letter re "Improved Circle Cool Pad and New Adjustable Spanner Wrench," Plymouth Products, Dec. 1, 2000, 2 pages.
Product Literature: Letter re "Phenolic Plate Sets," "Phenolic Plates," "Sav-A-Disc," Plymouth Products, Dec. 1, 2000, 3 pages.
Product Literature: Letter re "Abrasive Disc Cutter," "Poly Pads," "Polishing/Buffing Pads," "Rib Faced Rubber Pads," "Smooth Faced Rubber Pads," Plymouth Products, Dec. 1, 2000, 3 pages.
Price List: Plymouth Products, Jan. 1, 2001, 2 pages.

* cited by examiner

IN SITU ACTIVATION OF A THREE-DIMENSIONAL FIXED ABRASIVE ARTICLE

FIELD

This invention pertains to an assembly and a method for the in situ activation of a three-dimensional fixed abrasive article.

BACKGROUND

Abrasive articles are used in a variety of industrial applications for modifying (e.g., abrading, finishing, polishing, planarizing, etc.) surfaces during various phases of manufacture. For example, in manufacturing semiconductor devices, a wafer typically undergoes numerous processing steps, including deposition, patterning, and etching. After one or more of these processing steps it is necessary to achieve a high level of surface planarity and uniformity.

A conventional surface modifying technique comprises polishing, e.g., the chemical mechanical polishing (CMP) of a semiconductor wafer, wherein a wafer in a carrier assembly is rotated in contact with a polishing pad in a CMP apparatus. The polishing pad is mounted on a turntable or platen. The wafer is mounted on a rotating/moving carrier or polishing head, and a controllable force presses the wafer against the rotating polishing pad. Thus, the CMP apparatus produces polishing or rubbing movement between the surface of the wafer and the polishing pad. Optionally, polishing slurry containing abrasive particles in a solution can be dispersed on the pad and wafer. Typical CMP can be performed not only on a silicon wafer itself, but also on various dielectric layers, e.g., silicon oxide; conductive layers, e.g., aluminum and copper; or layers containing both conductive and dielectric materials, as in Damascene processing.

Chemical mechanical polishing may also be conducted using a fixed abrasive article, e.g., a fixed abrasive polishing sheet or fixed abrasive pad. Such a fixed abrasive article typically comprises a plurality of abrasive composites optionally adhered to a backing. The abrasive composites may comprise abrasive particles in a binder, e.g., a polymeric binder. A working fluid may be used with the fixed abrasive article and the wafer. A chemical agent can be provided, e.g., in a working fluid or incorporated in the fixed abrasive article, to provide chemical activity, while the fixed abrasive composites provide mechanical activity and, in some processes, chemical activity.

During CMP, the abrasive article becomes less active, i.e., the abrasive article becomes less effective at modifying the surface of a substrate. For example, as the abrasive article modifies the surface of a substrate, abrasive particles may be removed from the abrasive composites. As abrasive particles are removed from the abrasive composites, the rate of CMP may be reduced as the fixed abrasive article becomes less effective at providing mechanical and/or chemical activity. Also, abrasive particles remaining in the abrasive composites may become less active, e.g., less mechanically and/or chemically active. If these spent abrasive particles are not removed from the abrasive composites, the rate of CMP may be reduced as the fixed abrasive article becomes less effective at providing mechanical and/or chemical activity.

SUMMARY

The present inventors have determined that the abrasive article may be activated by eroding a portion of the abrasive composites thereby exposing fresh abrasive particles. Erosion of the abrasive composites is desired because it results in the replenishment of active abrasive particles at the surface of the fixed abrasive article. Erosion may also remove worn abrasive particles from the abrasive article. If the abrasive composite is not sufficiently erodible, fresh abrasive particles may not properly be exposed and cut rate may diminish. If the abrasive composites are too erodible, the abrasive article may have a shorter than desired product life.

The present inventors have also determined that there exists a need for fixed abrasive articles and CMP apparatuses that provide high wafer-to-wafer cut rate stability. There also exists a need for fixed abrasive articles, CMP apparatuses employing fixed abrasive articles and CMP methods using fixed abrasive articles which achieve at least one of the following: increase the steady-state cut rate, control the rate of erosion of abrasive composite elements; allow tailoring of a fixed abrasive article for use in processing a variety of substrate materials; enable a reduction in contamination during CMP; optimize the lifetime of a fixed abrasive article; and generally improve the efficiency, increase the manufacturing throughput and reduce the cost of CMP.

Briefly, in one aspect, the present invention provides an apparatus for the in situ activation of a three-dimensional fixed abrasive article. The apparatus comprises a substrate comprising a first surface; a three-dimensional fixed abrasive article comprising an abrasive surface and an opposing surface, wherein the abrasive surface comprises a plurality of abrasive composites; and a support assembly. The support assembly is selected to create a region of a high erosion force and a region of a low erosion force when a normal force is applied to the substrate, the fixed abrasive article and the support assembly and a relative motion is created between the first surface of the substrate and the abrasive surface of the fixed abrasive article. At least the high erosion force is sufficient to activate the fixed abrasive article, and the low erosion force is less than the high erosion force.

In yet another aspect, the present invention provides an apparatus for the in situ activation of a three-dimensional fixed abrasive article comprising a substrate comprising a first surface; a three-dimensional fixed abrasive article comprising an abrasive surface and an opposing surface, wherein the abrasive surface comprises a plurality of abrasive composites; and a support assembly. The support assembly comprises a means for creating a region of a high erosion force and a region of a low erosion force when a normal force is applied to the substrate, the fixed abrasive article and the support assembly and a relative motion is created between the first surface of the substrate and the abrasive surface of the fixed abrasive article. At least the high erosion force is sufficient to activate the fixed abrasive article, and the low erosion force is less than the high erosion force.

In yet another aspect, the present invention provides a method for the in situ activation of a three-dimensional fixed abrasive article. The method comprises providing a substrate comprising a first surface, and a three-dimensional fixed abrasive article comprising an abrasive surface and an opposing surface. The abrasive surface comprises a plurality of abrasive composites. The method further comprises contacting the opposing surface of the fixed abrasive article with a support assembly; contacting the first surface of the substrate with the abrasive surface of the fixed abrasive article; applying a normal force to the substrate, the fixed abrasive article and the support assembly; and providing a relative motion between the first surface of the substrate and the abrasive surface of the fixed abrasive article. The applied normal force and the relative motion between the first surface of the substrate and the abrasive surface create erosion forces. The support assembly is selected to create a region of a high erosion force and a region of a low erosion force, wherein at least the high erosion force is sufficient to activate the fixed abrasive article, and wherein the low erosion force is less than the high erosion force.

In another aspect, the present invention further comprises indexing the fixed abrasive article relative to the support assembly such that at least a portion of the abrasive composites move from the region of the high erosion force to the region of the low erosion force.

It was thought that uniform erosion forces were required to maintain uniform substrate surface modification during CMP, however, the present inventors have discovered that uniformity of surface modification, cut rate consistency, and steady-state cut rate improvements can be achieved using a fixed abrasive assembly having spatially modulated erosion forces. Fixed abrasive assemblies having spatially modulated erosion forces may be used to activate a fixed abrasive article in situ. Fixed abrasive assemblies having spatially modulated erosion forces may also be used to tailor a fixed abrasive article for use in processing a variety of substrate materials.

The details of one or more embodiments of the invention are set forth in the description below. Other features, objects, and advantages of the invention will be apparent from the description and from the claims.

DETAILED DESCRIPTION

Figure 1:
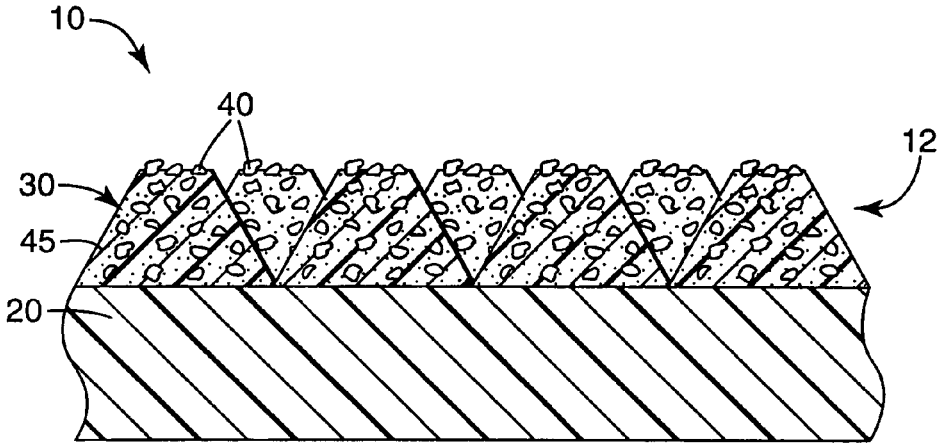
FIG. 1 shows a textured, three-dimensional, fixed abrasive article.

Generally, an abrasive article is an article capable of mechanically and/or chemically removing material from a surface of a substrate. An abrasive article can be a fixed abrasive article, i.e., an abrasive article that comprises a plurality of abrasive particles in fixed positions in a binder. A fixed abrasive article is substantially free of unattached abrasive particles except as may be generated during the planarization process. Although these unattached abrasive particles may be present temporarily, they are generally removed from the interface between the fixed abrasive article and the substrate undergoing CMP and do not substantially contribute to the surface modification process. The abrasive article may be a three-dimensional fixed abrasive article having abrasive particles dispersed throughout at least a portion of its thickness such that erosion exposes additional abrasive particles. The abrasive article can also be textured such that it includes raised portions and recessed portions in which at least the raised portions include abrasive particles in a binder. Fixed abrasive articles are described, for example, in U.S. Pat. Nos. 5,014,468; 5,453,312; 5,454,844; 5,692,950; 5,820,450; and 5,958,794; and WO 98/49723.

In some embodiments, the fixed abrasive article may include a backing. Any known backing may be used. For example, polymeric films, fabrics, metal foils, nonwovens, and combinations thereof may be used. In addition, Bruxvoort et al. in U.S. Pat. No. 5,958,794 (column 17, line 12 through column 18, line 15 of which is incorporated herein by reference) describe useful backings. Particular selection is within the skill in the art.

In some embodiments, fixed abrasive articles include abrasive composites. Abrasive composites are known in the art of fixed abrasive articles and may comprise abrasive particles dispersed throughout a binder. In some embodiments, an abrasive composite may comprise a polymeric material having separate phases, with one phase acting as abrasive particles.

Any known binder may be used. For example, (meth) acrylates, epoxies, urethanes, polystyrenes, vinyls, and combinations thereof may be used. In addition, Bruxvoort et al. in U.S. Pat. No. 5,958,794 (column 22, line 64 through column 34, line 5 of which is incorporated herein by reference) describe useful binders. Particular selection is within the skill in the art.

Any known abrasive particles may be used. For example, Bruxvoort et al. in U.S. Pat. No. 5,958,794 (column 18, line 16 through column 21, line 25 of which is incorporated herein by reference) describe useful abrasive particles. Particular selection is within the skill in the art.

In some embodiments, the abrasive particles have an average particle size no greater than about 10 micrometers (μm) (e.g., no greater than about 5 μm, or no greater than about 1 μm, or no greater than about 0.5 μm, or no greater than about 0.1 μm). In some embodiments, the abrasive particles may be in the form of abrasive agglomerates, which comprise a plurality of individual abrasive particles bonded together to form a unitary particulate mass. The abrasive agglomerates may be irregularly shaped or may have a predetermined shape. In some embodiments, the abrasive agglomerate may use an organic binder or an inorganic binder to bond the abrasive particles together. In some embodiments, abrasive agglomerates have a particle size less than about 100 μm (e.g., less than about 50 μm, or less than about 25 μm, or less than about 5 μm, or less than about 1 μm, or less than about 0.5 μm). In some embodiments, the individual abrasive particles in the abrasive agglomerate have an average particle size no greater than about 10 μm (e.g., no greater than about 5 μm, or no greater than about 1 μm, or no greater than about 0.5 μm, or no greater than about 0.1 μm). Examples of abrasive agglomerates are further described in U.S. Pat. Nos. 4,652,275; 4,799,939; and 5,500,273.

In some embodiments, e.g., where it is desirable to avoid harming a surface of a substrate such as a semiconductor wafer (e.g., where the wafer surface is a metal oxide-containing surface such as a silicon dioxide-containing surface), the abrasive particles may be selected to have a Mohs hardness value of no greater than about 8. In some embodiments, abrasive particles having a Mohs hardness of greater than about 8 may be useful. In some embodiments, abrasive particles include particles made of metal oxide materials such as, e.g., ceria, alumina, and silica. In some embodiments, the abrasive particles are chemically active relative to the substrate being modified, e.g., ceria.

In some embodiments, the abrasive composites may contain other particles, e.g., filler particles, in combination with the abrasive particles, in amounts that are understood in the art of fixed abrasive articles. Examples of filler particles include carbonates (e.g., calcium carbonate), silicates (e.g., magnesium silicate, aluminum silicate, calcium silicate, and combinations thereof), and combinations thereof. Polymeric filler particles may also be used alone or in combination with other filler particles.

In some embodiments, the fixed abrasive article of the invention may include an abrasive composite that is a "precisely-shaped" abrasive composite. A precisely-shaped abrasive composite is an abrasive composite having a molded shape that is the inverse of a mold cavity used to make the precisely-shaped abrasive composite, wherein the molded shape is retained after the abrasive composite has been removed from the mold. In some embodiments, the abrasive composites may slump or deform after removal from the mold. In some embodiments, the abrasive composites may be formed without the use of a mold cavity. In some embodiments, the abrasive composites may be formed by rotogravure printing or screen printing. In some embodiments, the abrasive composites are substantially free of abrasive particles protruding beyond the exposed surface of the shape before the abrasive article is first used, as described in U.S. Pat. No. 5,152,917.

Abrasive composite can take any useful form or shape, with preferred shapes including cubical, cylindrical, truncated cylindrical, prismatic, conical, truncated conical, pyramidal, truncated pyramidal, cross, post-like with flat top surface, hemispherical, the reverse of any one or more of these, and combinations thereof. Appropriate sizes and spacings of the abrasive composites will also be appreciated and understood by one skilled in the art of fixed abrasive articles. Generally, useful shapes of the abrasive composites can be any shape that will usefully modify the surface of a selected substrate. In some embodiments, substantially all of the abrasive composites have the same shape.

Abrasive composites may be directly adjacent to or spaced apart from each other. For example, in some embodiments, they may be provided in the form of elongated ridges spaced apart from each other, e.g., such that channels form between adjacent abrasive composite ridge elements. In some embodiments, each of the abrasive composites can have substantially the same orientation relative to the backing.

In some embodiments, the fixed abrasive article includes a plurality of abrasive composites arranged in the form of a precisely shaped pattern. In some embodiments, all of the abrasive composites have substantially the same height.

In some embodiments, the abrasive article should provide a good cut rate. In some embodiments, the abrasive article is capable of yielding a processed substrate, e.g., a semiconductor wafer, having an acceptable flatness and surface finish, and minimal dishing. In some embodiments, the fixed abrasive article is capable of yielding consistent levels of flatness, surface finish, and dishing over a series of consecutive surface modification processes. In some embodiments, it may be desirable to use the same fixed abrasive article to process different substrates.

When a substrate is modified with a particular working area of a fixed abrasive article, an initial cut rate (i.e., material removal rate, often reported in units of angstroms per minute) will be achieved. As the same working area of the fixed abrasive article modifies subsequent substrates, the cut rate will decrease asymptotically to some stable cut rate. By indexing the abrasive article (i.e., incrementally or continuously advancing fresh abrasive article into the working area), the stable cut rate may be increased. In some embodiments, the fixed abrasive article may be indexed between polishing operations on individual substrates.

In some embodiments, the fixed abrasive articles are erodible. Erosion of a fixed abrasive article may activate the fixed abrasive article, i.e., replenish active abrasive particles at the surface of the fixed abrasive article.

In some embodiments, activation of the fixed abrasive article at least partially restores the cut rate obtained when modifying a substrate with a fixed abrasive article. Activation typically involves the erosion of a portion of the fixed abrasive article with the resulting exposure, at the contacting surface, of abrasive particles that have not previously contacted the substrate. Generally, textured substrates (e.g., silicon wafers with topography, pre-planarized semiconductor wafers, and substrates with coarse surface finishes) are initially capable of activating a fixed abrasive article, but may become incapable of activating the fixed abrasive article as their surface texture is reduced. Some relatively smooth substrates (e.g., planarized semiconductor wafers and blanket wafers) may be incapable of activating some fixed abrasive articles.

In some embodiments, an activated fixed abrasive article will have a cut rate of no less than about 20% (e.g., no less than about 50%, or no less than about 70%, or no less than about 90%) of the initial cut rate achieved with the fixed abrasive article. The cut rate achieved with the fixed abrasive article may have been reduced as a consequence of modifying a single substrate or it may have been reduced as a consequence of modifying multiple substrates.

In some embodiments, activation of a fixed abrasive article increases the steady-state cut rate obtained when modifying the surfaces of a plurality of substrates. The cut rate obtained when modifying the surface of the first substrate with a fresh abrasive article may be high. However, the cut rate obtained for the second and subsequent substrates may tend to decrease until a steady-state rate is observed. Although indexing the abrasive article between substrates may increase the steady-state rate, the steady-state rate may still be unacceptably low. In some embodiments, an activated fixed abrasive article will have a steady-state cut rate of no less than about 115% (e.g., no less than about 150%, or no less than about 200%, or no less than about 300%) of the steady-state cut rate achieved with an indexed abrasive article absent sufficient activation.

If the fixed abrasive article is not sufficiently erodible, fresh abrasive particles may not properly be exposed. This may result in the inadequate activation, or, in some cases, no activation, of the abrasive article. This may cause a decrease in the cut rate, and variability in the levels of flatness, surface finish, and dishing.

If the fixed abrasive article is too erodible, it may result in an abrasive article with a shorter than desired product life. Also, erosion debris may detrimentally affect the surface finish (e.g., cause scratches).

For specific applications, the degree of erosion of an abrasive composites can be a function of a variety of factors, including, e.g., the composition and surface texture of the substrate; the surface texture of the fixed abrasive article, including the shape of the abrasive composite elements; the mechanical properties of the abrasive composites, including, e.g., their cohesive strength, shear strength and brittleness; the conditions of use, including, e.g., the pressure and rate of relative motion between the fixed abrasive article and the substrate; and whether a working fluid is used during the process.

Generally, the harder a substrate relative to the abrasive composite elements, the greater will be the rate of erosion. Thus, a fixed abrasive article that is suitable for a substrate of a particular hardness may not be suited for substrate that is softer.

Generally, the greater the surface texture of a particular substrate, the more erosion that may occur. That is, as the surface texture of a substrate decreases (i.e., as the substrate becomes smoother), the ability of that substrate to erode the abrasive composite elements generally decreases. Thus, a fixed abrasive article that is suited for processing a given substrate when the substrate's surface is relatively rough, may not perform as well when the substrate's surface is relatively smooth.

In some embodiments, the binder contains a plasticizer in an amount sufficient to increase erodibility of the fixed abrasive article relative to the same fixed abrasive article containing no plasticizer. In some embodiments, the binder includes at least about 25% (e.g. at least about 40%) by weight of the plasticizer based upon the total weight of the binder. In some embodiments, the binder includes no more than about 80% (e.g. no more than about 70%) by weight of the plasticizer based upon the total weight of the binder. In some embodiments, the plasticizers are phthalate esters, as well as derivatives thereof. This may result in an abrasive article that is better suited for modifying softer substrates. However, this may also result in an abrasive article that is too erodible to be used with harder substrates.

Referring to FIG. 1, fixed abrasive article 10 is three-dimensional, and comprises a plurality of erodible abrasive composites 30 bonded to optional backing 20. Abrasive composites 30 comprise a plurality of abrasive particles 40 dispersed in binder 45. The upper surface of the fixed abrasive article, i.e., the side of the fixed abrasive article having a face that includes the abrasive composites 30, will be referred to generally as the abrasive surface 12.

Figure 2:
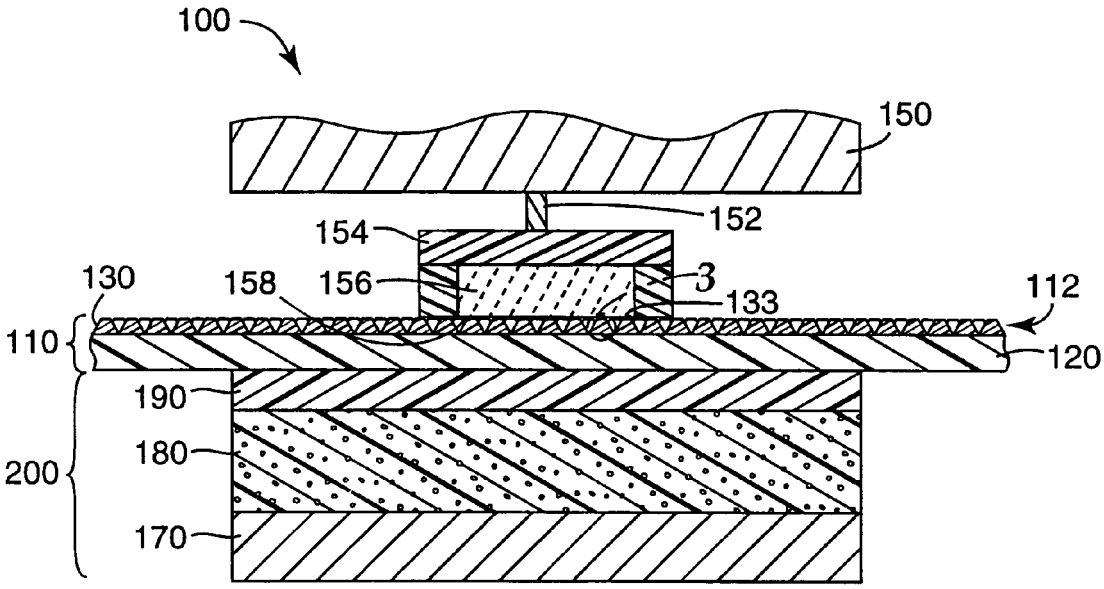
FIG. 2 shows a simplified apparatus that may be used for surface modification.

FIG. 2 illustrates simplified apparatus 100 which may be used for modifying substrates. Apparatus 100 comprises head unit 150 that is connected to a motor (not shown). Chuck 152, an example of which is a gimble chuck, extends from head unit 150. At the end of chuck 152 is substrate holder 154. In some embodiments, chuck 152 may be designed such that is will accommodate different forces and allow substrate holder 154 to pivot so that fixed abrasive article 110 can provide the desired surface finish and flatness to surface 158 of substrate 156. However, in some embodiments, chuck 152 may not allow substrate holder 154 to pivot during substrate surface modification.

Fixed abrasive article 110 is adjacent support assembly 200. Generally, support assembly 200 comprises platen 170, e.g., a machine platen used in chemical mechanical planarization, resilient substrate 180, and rigid substrate 190. In some embodiments, additional substrates may be present. The choice of materials for the rigid substrate 190 and resilient substrate 180 will vary depending on the composition, shape, and initial flatness of the substrate surface to be modified, the composition of the fixed abrasive article, the type of apparatus used for modifying the surface (e.g., planarizing the surface), the pressures used in the modification process, etc.

Materials suitable for use in the rigid substrate can be characterized using, for example, standard test methods proposed by ASTM. Static tension testing of rigid materials can be used to measure the Young's Modulus (often referred to as the elastic modulus) in the plane of the material. For measuring the Young's Modulus of a metal, ASTM E345-93 (Standard Test Methods of Tension Testing of Metallic Foil) can be used. For measuring the Young's Modulus of an organic polymer (e.g., plastics or reinforced plastics), ASTM D638-84 (Standard Test Methods for Tensile Properties of Plastics) and ASTM D882-88 (Standard Tensile Properties of Thin Plastic Sheet) can be used. For laminated elements that include multiple layers of materials, the Young's Modulus of the overall element (i.e., the laminate modulus) can be measured using the test for the highest modulus material. In some embodiments, rigid materials (or the overall rigid element itself) have a Young's Modulus value of at least about 100 MPa. The Young's Modulus of the rigid element may be determined by the appropriate ASTM test in the plane defined by the two major surfaces of the material at room temperature (20–25° C.).

The rigid substrate can be a continuous layer or a discontinuous, e.g., divided into segments, layer. The rigid substrate can be in a variety of forms including, e.g., a discrete sheet, e.g., a round disk; or a continuous web, e.g., a belt. The rigid substrate can include a layer of material or a number of layers of the same material or different materials, provided that the mechanical behavior of the rigid substrate is acceptable for the desired application.

Suitable rigid substrate materials include, e.g., organic polymers, inorganic polymers, ceramics, metals, composites of organic polymers, and combinations thereof. Suitable organic polymers can be thermoplastic or thermoset. Suitable thermoplastic materials include, polycarbonates, polyesters, polyurethanes, polystyrenes, polyolefins, polyperfluoroolefins, polyvinyl chlorides, and copolymers thereof. Suitable thermosetting polymers include, e.g., epoxies, polyimides, polyesters, and copolymers thereof (i.e., polymers containing at least two different monomers including, e.g., terpolymers and tetrapolymers).

The rigid substrate may be reinforced. The reinforcement can be in the form of fibers or particulate material. Suitable materials for use as reinforcement include, e.g., organic or inorganic fibers (e.g., continuous or staple); silicates, e.g., mica or talc; silica-based materials, e.g., sand and quartz; metal particulates; glass; metallic oxides; calcium carbonate; or a combination thereof.

Metal sheets can also be used as the rigid substrate. In some embodiments, the metal sheet is very thin, e.g., from about 0.075 to about 0.25 mm. Suitable metals include, e.g., aluminum, stainless steel, copper, nickel, and chromium.

Particularly useful rigid materials include poly(ethylene terephthalate), polycarbonate, glass fiber reinforced epoxy boards, aluminum, stainless steel and IC 1000 (available from Rodel, Inc., Newark, Del.).

The resilient substrate can be a continuous layer or a discontinuous, e.g., divided into segments, layer. The resilient substrate can be in a variety of forms including, e.g., a discrete sheet, e.g., a round disk; or a continuous web, e.g., a belt. The resilient substrate can include a layer of material or a number of layers of the same material or different materials, provided that the mechanical behavior of the resilient substrate is acceptable for the desired application.

The resilient substrate is preferably capable of undergoing compression during a surface modification process. The resiliency, i.e., the stiffness in compression and elastic rebound, of the resilient substrate is related to the modulus in the thickness direction of the material(s) composing the resilient substrate and the thickness of the resilient substrate.

The choice of material(s) for the resilient substrate, as well as the thickness of the resilient substrate, may vary depending on the variables in the process including, e.g., the composition of the substrate surface being modified and the fixed abrasive article, the shape and initial flatness of the substrate surface, the type of apparatus used for modifying the surface (e.g., planarizing the surface), and the pressures used it the modifying process.

In some embodiments, a resilient material including, e.g., the overall resilient substrate, has a Young's modulus of less than about 100 megaPascals (MPa) (e.g., less than about 50 MPa). Dynamic compressive testing of resilient materials can be used to measure the Young's Modulus (often referred to as the storage or elastic modulus) in the thickness direction of the resilient material. ASTM D5024-94 (Standard Test methods for measuring the Dynamic Mechanical properties of Plastics in Compression) is a useful method for measuring the Young's Modulus of a resilient substrate, whether the resilient substrate is one layer or a laminated substrate that includes multiple layers of materials. The Young's Modulus of the resilient substrate may be determined according to ASTM D5024-94 with the material at 20° C., a frequency of 0.1 Hz, and a preload equal to the nominal CMP process pressure.

Suitable resilient materials can also be selected by additionally evaluating their stress relaxation. Stress relaxation is evaluated by deforming a material and holding it in the deformed state while the force or stress needed to maintain deformation is measured. In some embodiments, resilient materials retain at least about 60% (e.g., at least about 70%) of the initially applied stress, after 120 seconds. This is referred to herein as the "remaining stress" and is determined by first compressing a sample of material to no less than 0.5 mm thick at a rate of 25.4 mm/minute until an initial stress of 83 kiloPascals (kPa) is achieved at room temperature (20° C.–25° C.) and measuring the remaining stress after 120 seconds.

The resilient substrate can include a wide variety of resilient materials. Examples of useful resilient materials include, e.g., organic polymers including, e.g., thermoplastic, thermoset, and elastomeric organic polymers. Suitable organic polymers include those organic polymers that are foamed or blown to produce porous organic structures, i.e., foams. Such foams may be prepared from natural or synthetic rubber or other thermoplastic elastomers including, e.g., polyolefins, polyesters, polyamides, polyurethanes, and copolymers thereof. Suitable synthetic thermoplastic elastomers include, e.g., chloroprene rubbers, ethylene/propylene rubbers, butyl rubbers, polybutadienes, polyisoprenes, EPDM polymer, polyvinyl chlorides, polychloroprenes, styrene-butadiene copolymers, and styrene-isoprene copolymers, and mixtures thereof. One example of a useful resilient material is a copolymer of polyethylene and ethylvinyl acetate in the form of a foam.

Other useful resilient materials include polyurethane impregnated felt-based materials; nonwoven or woven fiber mats that include, e.g., polyolefin, polyester or polyamide fibers; and resin impregnated woven and nonwoven materials.

Examples of useful commercially available resilient materials include poly(ethylene-co-vinyl acetate) foams available under the trade designations 3M SCOTCH brand CUSHIONMOUNT Plate Mounting Tape 949 (a double-coated high density elastomeric foam tape available from 3M Company, located in St. Paul, Minn.), EO EVA foam available from Voltek (Lawrence, Mass.), EMR 1025 polyethylene foam available from Sentinel Products (Hyannis, N.J.), HD200 polyurethane foam available from Illburck, Inc. (Minneapolis, Minn.), MC8000 and MC8000 EVA foams available from Sentinel Products, and SUBA IV Impregnated Nonwoven available from Rodel, Inc. (Newark, Del.).

Commercially available pads having rigid and resilient layers that are used in slurry polishing operations are also suitable. An example of such a pad is available as IC1000-SUBA IV (Rodel, Inc.).

Fixed abrasive article 110, resilient substrate 180, and rigid substrate 190 can be maintained in fixed relation to each other by an attachment mechanism. Examples of useful means for maintaining one component in fixed relation to another include, e.g., adhesive compositions, mechanical fastening devices, tie layers, and combinations thereof. The components can also be bonded together through processes including, e.g., thermal bonding, ultrasonic welding, microwave-activated bonding, coextrusion of at least two components, and combinations thereof.

Useful adhesives include, e.g., pressure sensitive adhesives, hot melt adhesives and glue. Suitable pressure sensitive adhesives include a wide variety of pressure sensitive adhesives including, e.g., natural rubber-based adhesives, (meth)acrylate polymers and copolymers, AB or ABA block copolymers of thermoplastic rubbers, e.g., styrene/butadiene or styrene/isoprene block copolymers available as KRATON (Shell Chemical Co., Houston, Tex.) or polyolefins. Suitable hot melt adhesives include, e.g., polyester, ethylene vinyl acetate (EVA), polyamides, epoxies, and combinations thereof. In some embodiments, the adhesive has sufficient cohesive strength and peel resistance to maintain the components in fixed relation to each other during use, and is resistant to chemical degradation under conditions of use.

A variety of mechanisms may be used for attachment of one or more components to platen 170, e.g., adhesive or mechanical means including, e.g., placement pins, retaining ring, tension, vacuum or a combination thereof.

Head unit 150 applies a normal force to substrate 156, abrasive article 110, and support assembly 200, creating a contact pressure between abrasive surface 112 of abrasive article 110 and surface 158 of substrate 156. Relative motion (e.g., rotation, oscillation, random, and combinations thereof) between the substrate 156 and abrasive article 110, with contact pressure, results in modification of surface 158.

In some embodiments, fixed abrasive article 110 can be indexed (i.e., advanced incrementally or continuously) relative to one or more components of support assembly 200. In some embodiments, the fixed abrasive article is a continuous belt and the continuous belt is indexed by a drive mechanism (not shown), e.g., a linear drive mechanism. The belt may pass over one or more idler (i.e., non-driven) rollers (not shown) and/or turn bars (not shown). In some embodiments, the fixed abrasive article is a roll of fixed abrasive. The roll may be mounted on a supply roll (not shown), with the leading edge of the roll connected to a take-up roll (not shown). The fixed abrasive article passes over the support assembly (e.g., a stationary support assembly, or a rotating support assembly), such that the abrasive article is adjacent the support assembly. The fixed abrasive article is indexed by rotating the take-up roll such that the roll of fixed abrasive article unwinds from the supply roll and winds onto the take-up roll. The fixed abrasive article may pass over one or more idler rolls and/or turn bars. In some embodiments, the supply roll and take-up roll are attached to the support assembly. In some embodiments, the supply roll and the take-up roll rotate with the support assembly.

In some embodiments, resilient substrate 180, rigid substrate 190, or both may be indexed relative to platen 170 and/or fixed abrasive article 110.

Abrasive surface 112 comprises a plurality of abrasive composites 130. Generally, during the surface modification process, top surface 133 of some abrasive composites 130 contact surface 158 of substrate 156. During processing, abrasive particles (not shown) in abrasive composites 130 modify surface 158 of substrate 156. As processing proceeds, abrasive composites 130 may erode away substantially uniformly toward backing 120. If the erosion is sufficient, abrasive composites 130 will be activated, ensuring a fresh supply of active abrasive particles (not shown).

FIGS. 3*a*–3*d* show single abrasive composite 330 during various stages of the surface modification process. In the following figures, the relative activity of an abrasive composite is represented by the number of abrasive particles present on the top surface of an abrasive composite. However, an abrasive composite may also become less active due to, e.g., mechanical wearing of the abrasive particles or a decrease in the chemical activity of the abrasive particles.

Figure 3A:
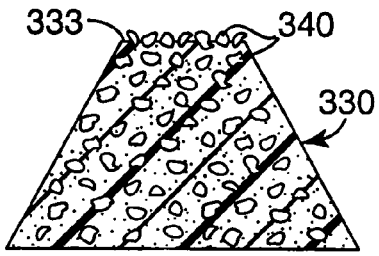
FIG. 3*a* shows a cross sectional view of an abrasive composite prior to modifying a substrate.
Figure 3B:
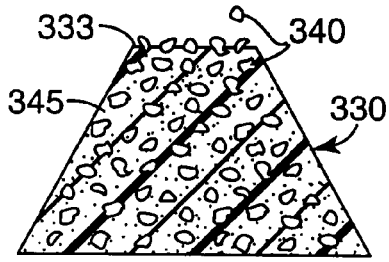
FIG. 3*b* shows a cross sectional view of the abrasive composite of FIG. 3*a* after modifying a substrate.
Figure 3C:
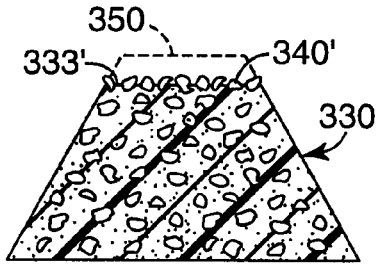
FIG. 3*c* shows a cross sectional view of the abrasive composite of FIG. 3*a* when the abrasive composite undergoes activation.

Initially, top surface 333 of abrasive composite 330 is covered with many active abrasive particles 340. As the surface of a substrate (not shown) is modified by abrasive composite 330, abrasive composite 330 becomes less active. For example, abrasive particles 340 may be released from top surface 333. As shown in FIG. 3*b*, this will result in a reduction in the number of active abrasive particles 340 present on top surface 333, and may result in a reduction in the cut rate. With some substrates and under some operating conditions, abrasive composite 330 may erode during the surface modification process. Erosion involves the wearing away of binder 345 of abrasive composite 330. As shown in FIG. 3*c*, after region 350 of abrasive composite 330 is eroded, fresh top surface 333' and fresh abrasive particles 340' are exposed.

Figure 3D:
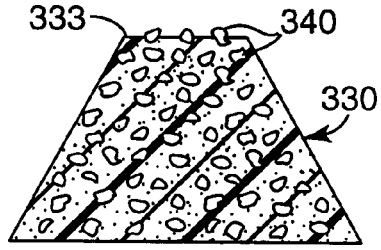
FIG. 3*d* shows a cross sectional view of the abrasive composite of FIG. 3*a* when the abrasive composite does not undergo activation.

With some substrates and under some operating conditions, abrasive composite 330 does not erode or erodes at an unacceptably slow rate. As shown in FIG. 3*d*, this may result in a substantially reduced number of active abrasive particles 340 present on top surface 333 of abrasive composite 330.

As discussed above, it may be possible to modify the binder (e.g., add a plasticizer) to enable or enhance erosion of an abrasive composite when modifying the surface of a particular substrate under a particular set of operating conditions. However, this may lead to unacceptably high rates of erosion with other substrates or under other operating conditions.

It is also possible to condition the fixed abrasive article in a process separate from the substrate surface modification process. Conditioning generally involves applying a conditioning pad (e.g., a diamond conditioning pad) to the abrasive surface of a fixed abrasive article. A load is applied and the conditioning pad is moved relative to the abrasive surface resulting in the erosion of the abrasive composites. This activates the abrasive composites, creating fresh top surfaces with fresh abrasive particles. However, this conditioning requires additional equipment and consumables, and may require separate processing steps. Equipment is available to allow one portion of a fixed abrasive article to modify the surface of a substrate while a separate portion of the fixed abrasive article is conditioned; however, additional equipment and consumables are still required. In addition, conditioning pads may remove larger pieces of the abrasive composite than occurs with controlled erosion. Larger pieces of debris are thought to contribute to undesirable scratching of the surface of the substrate being modified.

Figure 4:
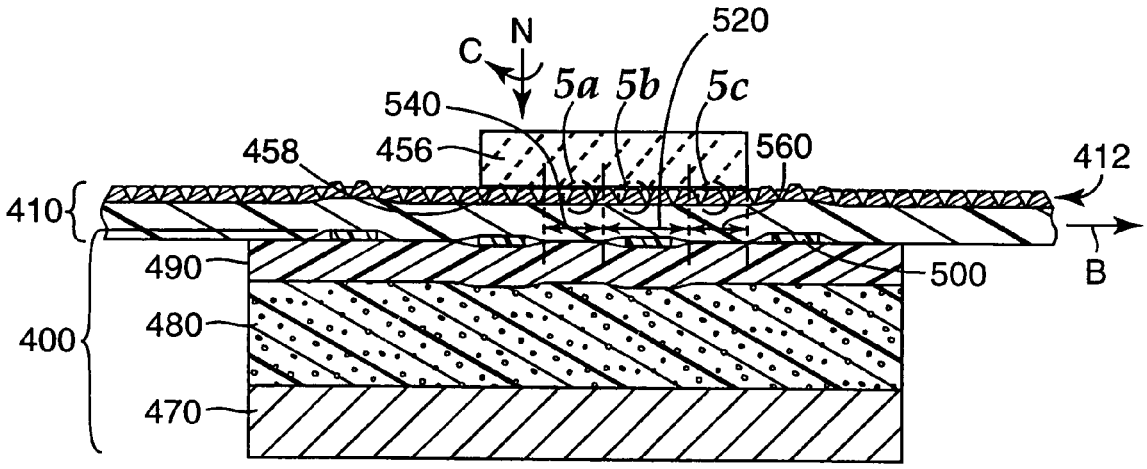
FIG. 4 shows a substrate contacting an abrasive assembly in one embodiment of the present invention.

FIG. 4 shows one embodiment of the present invention, wherein fixed abrasive article 410 undergoes in situ activation. Surface 458 of substrate 456 contacts abrasive surface 412 of fixed abrasive article 410. Abrasive article 410 is supported by support assembly 400, which comprises platen 470, resilient layer 480, rigid layer 490, and spacers 500. Spacers 500 are shown positioned between rigid layer 490 and fixed abrasive article 410. In some embodiments, spacers 500 may be located between rigid layer 490 and resilient layer 480. In some embodiments, spacers 500 may be located between resilient layer 480 and platen 470. In some embodiments, the support assembly comprises additional layers, e.g., adhesive layers. Spacers may be present at the interface between any pair of adjacent layers. In some embodiments, spacers 500 may be located at more than one interface.

In some embodiments, spacers 500 may not be present. For example, in some embodiments, the function of the spacers may be provided by variations in the thickness of one or more of the rigid substrate, the resilient substrate, or other layers present in the support assembly. In some embodiments, the function of the spacers may be provided by variations in the mechanical properties (e.g., density, modulus, etc.) of one or more of the rigid substrate, the resilient substrate, and other layers. In some embodiments, the function of the spacers may be provided by raised regions and/or grooves in the platen.

Although four parallel spacers 500 having rectangular cross-sections are shown in FIG. 4, the number, shape, dimensions and orientation of spacers 500 may be varied. In some embodiments, spacers 500 may have the same or different dimensions. The gap between adjacent spacers may be substantially constant or it may be varied.

Normal force N is applied to substrate 456, fixed abrasive article 410, and support assembly 400 creating contact pressure between surface 458 of substrate 456 and abrasive surface 412 of abrasive article 410. Support assembly 400 spatially modulates the contact pressure. That is, spatial variations in the support assembly, e.g., the presence of spacers, and/or variations in mechanical properties and/or the thickness of one or more layers, generate regions of higher and lower contact pressure. Generally, the contact pressure will be higher in the regions proximate spacers 500 relative to the contact pressure in the regions proximate the gaps between spacers 500. Likewise, generally, the contact pressure will be higher in the regions proximate areas where one or more layers of the support assembly are thicker or have, e.g., a higher density or greater compressive modulus, and lower in the regions proximate the gaps between these areas.

During substrate modification, relative motion C is created between substrate 456 and fixed abrasive article 410. The combination of the contact pressure and relative motion C leads to erosion forces at the interface between abrasive surface 412 of fixed abrasive article 410 and surface 458 of substrate 456. The spatial modulation of the contact pressure creates regions of high and low erosion force, i.e., regions having higher contact pressure will be associated with higher erosion force.

In some embodiments, there is a plurality of regions of high erosion force separated by gaps comprising regions of low erosion force. In some embodiments, the erosion forces in two or more regions of high erosion force are substantially the same. In some embodiments, the erosion forces in substantially all of the regions of high erosion force are substantially the same. In some embodiments, the erosion forces in two or more regions of high erosion force are different. In some embodiments, the erosion forces in substantially all of the regions of high erosion force are different. The erosion force in each of the regions of high erosion force is sufficient to activate the fixed abrasive article.

In some embodiments, there is a plurality of regions of low erosion force. In some embodiments, the erosion forces in two or more regions of low erosion force are substantially the same. In some embodiments, the erosion forces in substantially all of the regions of low erosion force are substantially the same. In some embodiments, the erosion forces in two or more regions of low erosion force are different. In some embodiments, the erosion forces in substantially all of the regions of low erosion force are different.

FIG. 4 shows first region of first erosion force 520, second region of second erosion force 540 and third region of third erosion force 560. The first erosion force is greater than the average erosion force, i.e., first region of first erosion force 520 is a region of high erosion force. The second and third erosion forces are less than the average erosion force, i.e., second region of second erosion force 540 and third region of third erosion force 560 are regions of low erosion force. The boundaries between regions of high and low erosion force will be determined by, for example, the size, shape, and orientation of spacers 500, or other features of the support assembly giving rise to the spatially modulated contact pressure. These boundaries do not necessarily correspond to the boundaries of spacers 500.

In some embodiments, abrasive surface 412 of fixed abrasive article 410 substantially conforms to surface 458 of substrate 456. In some embodiments, abrasive surface 412 may not substantially conform to surface 458 between adjacent regions of higher contact pressure.

Figure 5A:
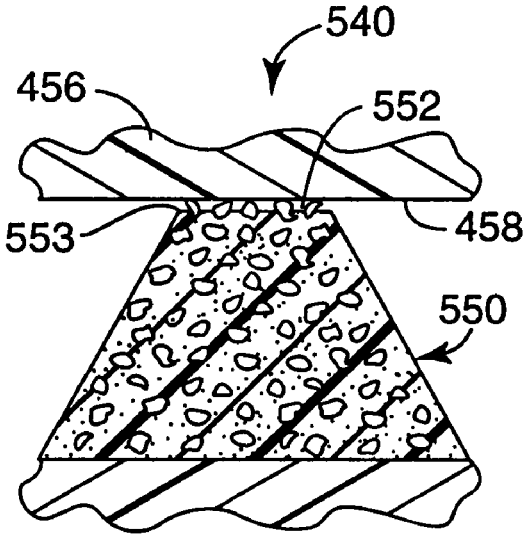
FIG. 5*a* shows an idealized abrasive composite in a region of low erosion forces prior to in situ activation.

FIG. 5*a* shows abrasive composite 550 in second region of second erosion force 540. Abrasive composite 550 is shown in a state of decreased activation (e.g., there are relatively fewer abrasive particles 552 on top surface 553). For example, abrasive composite 550 may have participated in modifying the surface one or more substrates since it was last activated. At least top surface 553 of abrasive composite 550 contacts surface 458 of substrate 456 during processing. As processing proceeds and surface 458 of substrate 456 is modified by abrasive particles 552 of abrasive composite 550, the effectiveness of abrasive composite 550 is reduced as, e.g., abrasive particles 552 are removed from abrasive composite 550, or become less active.

In some embodiments, the low erosion force in second region of second erosion force 540 is insufficient to activate abrasive composite 550 and expose fresh abrasive particles 552, i.e., abrasive composite 550 is not activated is situ. In some embodiments, abrasive composite 550 may undergo some level of erosion in second region of second erosion force 540. However, the amount of erosion may not be sufficient to activate the composite, i.e. create a surface having sufficient fresh abrasive particles to restore the cut rate of the composite to the desired level, or to increase the steady-state cut rate to the desired level.

Figure 5B:
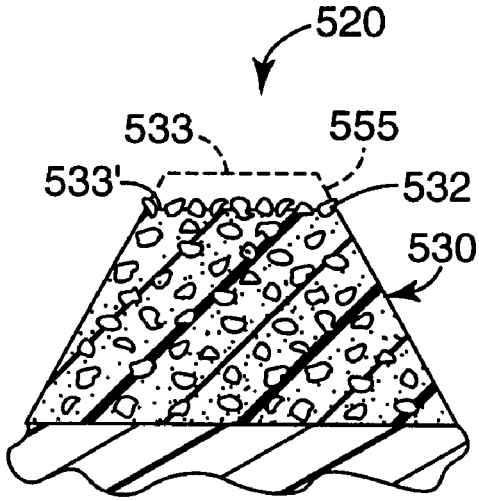
FIG. 5*b* shows an idealized abrasive composite in a region of high erosion forces undergoing in situ activation.

FIG. 5*b* shows abrasive composite 530 in first region of first erosion force 520. At least top surface 533 of abrasive composite 530 contacts the surface of the substrate (not shown) during processing. As processing proceeds, the surface of the substrate is modified by abrasive particles 532 of abrasive composite 530. Also, the high erosion force in first region of first erosion force 520 is sufficient to erode portion 555 of abrasive composite 530, thus exposing surface 533' and fresh abrasive particles 532. Thus, in first region of first erosion force 520, abrasive composite 530 undergoes in situ activation while simultaneously modifying the surface of a substrate.

When the abrasive article is indexed relative to the support assembly as shwon by arrow B in FIG. 4, some abrasive composites advance from second region of second erosion force 540 to first region of first erosion force 520 where they will undergo activation. Also, some abrasive composites will advance from first region of first erosion force 520 to third region of third erosion force 560 where they will continue to modify surface 456 of substrate 458.

Figure 5C:
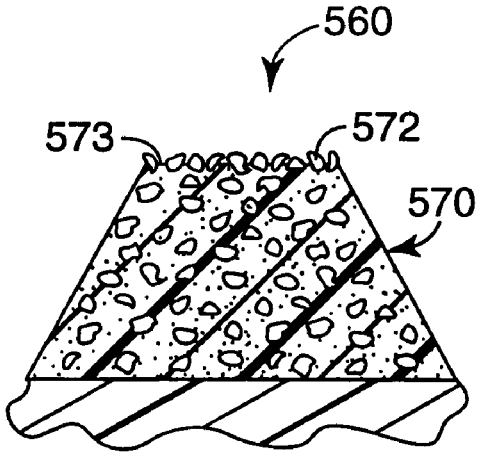
FIG. 5*c* shows an idealized abrasive composite in a region of low erosion forces after undergoing in situ activation.

FIG. 5*c* shows abrasive composite 570 in third region of third erosion force 560. At least top surface 573 of abrasive composite 570 contacts the surface of the substrate (not shown) during processing. As processing proceeds, and the surface of the substrate is modified by abrasive particles 572 of abrasive composite 570, the effectiveness of abrasive composite 570 is reduced as, e.g., abrasive particles 572 are removed from abrasive composite 570, or become worn (i.e., less mechanically effective), or less chemically effective.

In some embodiments, the low erosion force in third region of third erosion force 560 is not sufficient to activate abrasive composite 570. However, because abrasive composite 570 was activated in situ when it was present in first region of first erosion force 520, fresh abrasive particles 572 are present on top surface 573, thus abrasive composite 570 is expected to be more efficient at modifying surface 456 of substrate 458 than abrasive composite 550 which has modified one or more surfaces since being activated.

In some embodiments, abrasive composite 570 may undergo some level of erosion in third region of third erosion force 560. However, the amount of erosion may not be sufficient to activate the composite, i.e. create a surface having sufficient fresh abrasive particles to restore the cut rate of the composite to the desired level, or to increase the steady-state cut rate to the desired level.

If the gap between adjacent spacers is too small, the erosion force may not be adequately modulated, i.e., the high erosion force will be insufficient to activate the abrasive article. Likewise, if the gap between adjacent regions where one or more layer thicknesses are varied, or regions where the mechanical properties of one or more layers of the support assembly are varied, the erosion force may not be adequately modulated. The minimum gap may depend on the mechanical properties (e.g., compressibility, rigidity, conformability, etc.) of the layers located between the spacers and the substrate being modified, and the number of layers between the spacers and the substrate being modified. The minimum gap may also depend on dimensions (e.g., the width, length, and thickness) and mechanical properties of the spacers. The minimum gap may also depend on the magnitude of the thickness and/or mechanical property variations in one or more layers of the support assembly.

In some embodiments, the thickness of one or more layers in the support assembly (e.g., the resilient substrate, the rigid substrate, the platen, etc.) may vary spatially. As before, when a substrate is contacted with an abrasive article supported by such a support assembly and a normal force is applied, the structure of the support assembly may cause a spatial modulation of the contact pressure. This may result in a first region of high erosion force and a second region of low erosion force. By appropriate selection of the variation in the thickness of the layer(s) (e.g., the size, shape, dimensions, spacing, etc.), the high erosion force will be sufficient to activate the abrasive composites, and the low erosion force will be less than the high erosion force.

In some embodiments, the mechanical properties of one or more layers (e.g., the abrasive article, the rigid layer, the resilient layer, the platen, or any additional layers) may be varied to spatially modulate contact pressure and yield first and second regions of high and low erosion force, respectively. For example, the density, hardness, stiffness, compressibility, modulus, elasticity, and/or relaxation time of one or more layers may be adjusted. The variation in the mechanical property and/or properties may be selected to create a first region of high erosion force sufficient to activate abrasive composites, and a second region of low erosion force, wherein the low erosion force is less than the high erosion force.

In some embodiments, grooves may be placed in one or more layers of the support assembly. The size, shape, and locations of the grooves may be selected such that the grooves produce a first region of high erosion force and a second region of low erosion force, wherein the high erosion force is sufficient to activate the abrasive composites and the low erosion force is less than the high erosion force.

In some embodiments, a plurality of first regions of high erosion forces and/or a plurality of second regions of low erosion forces may be formed. The size, shape, and locations of the first and second regions may be varied provided that the high erosion forces are sufficient to activate the abrasive composites and the low erosion forces are less than the high erosion forces. In some embodiments, the erosion forces in each of the plurality of first regions are substantially the same. In some embodiments, the erosion forces in each of the plurality of first regions are different. In some embodiments, the erosion forces in each of the plurality of second regions are substantially the same. In some embodiments, the erosion forces in each of the plurality of second regions are different.

In some embodiments, at least two first regions of high erosion force are used, wherein the first regions are separated by a gap comprising a region of low erosion force. In some embodiments, the gap is greater than about 6 mm (e.g., greater than about 19 mm, or greater than about 30 mm, or greater than about 55 mm).

The assembly, including the support assembly and the fixed abrasive article, can be used in modifying the surface of a substrate. Some methods of using the fixed abrasive articles are apparent from the description above, but also relate to the more specific examples as follows.

The substrate may be any substrate that can be modified, e.g., abraded, polished, ground, planarized or otherwise modified, using a fixed abrasive article. In some embodiments, the substrate may be a wafer, e.g., a silicon, gallium arsenide, germanium, or sapphire wafer. In some embodiments, the substrate may be glass. In some embodiments, processes involve the modification of a surface of a semiconductor substrate. In some embodiments, processing may incorporate methods of chemical mechanical polishing.

A semiconductor substrate can comprise a microelectronic device such as a semiconductor wafer. A semiconductor wafer may comprise either a substantially pure surface or a surface processed with a coating or another material. Specifically, a semiconductor wafer may be in the form of a blank wafer (i.e., a wafer prior to processing for the purpose of adding topographical features such as metallized and insulating areas) or a processed wafer (i.e., a wafer after it has been subjected to one or more processing steps to add topographical features to the wafer surface). The term "processed wafer" includes, but it is not limited to, "blanket" wafers in which the entire exposed surface of the wafer is made of the same material (e.g., silicon dioxide). One area in which the method can be useful is where the exposed surface of a semiconductor wafer includes one or more metal oxide-containing areas, e.g., silicon dioxide-containing areas.

Methods of modifying a substrate surface using a fixed abrasive article are well known, and generally include contacting a substrate and a fixed abrasive article with a desired pressure and relative motion, e.g., rotational, linear, random, or otherwise, between them.

In some embodiments, surface modification can be conducted in the presence of a working fluid in contact with the substrate and the fixed abrasive article. In some embodiments, the working fluid is chosen based on the properties (e.g., composition, surface texture, etc.) of the substrate to provide the desired surface modification without adversely affecting or damaging the substrate. In some embodiments, the working fluid may contribute to processing, in combination with the fixed abrasive article, through a chemical mechanical polishing process. For example, the chemical polishing of $SiO_2$ occurs when a basic compound in the liquid reacts with the $SiO_2$ to form a surface layer of silicon hydroxides. The mechanical process occurs when an abrasive article removes the metal hydroxide from the surface.

In some embodiments, the working fluid typically comprises water, e.g., tap water, distilled water or deionized water. Generally, the working fluid aids processing in combination with the abrasive article through a chemical mechanical polishing process. During the chemical portion of polishing, the working fluid may react with the outer or exposed wafer surface. Then during the mechanical portion of processing, the abrasive article may remove this reaction product.

During the processing of some surfaces, it is preferred that the working fluid is an aqueous solution that includes a chemical etchant such as an oxidizing material or agent. For example, chemical polishing of copper may occur when an oxidizing agent in the working fluid reacts with the copper to form a surface layer of copper oxides. Alternatively, the metal may first be removed mechanically and then react with ingredients in the working fluid.

In some embodiments, the working fluid contains one or more complexing agents. Examples of suitable complexing agents include alkaline ammonia such as ammonium hydroxide with ammonium chloride and other ammonium salts and additives, ammonium carbonate, ferric nitrate, and combinations thereof.

In some embodiments, the complexing agent may be a monodentate complexing agent such as, e.g., ammonia, amines, halides, pseudohalides, carboxylates, thiolates, triethanol amine, and the like. In some embodiments, the complexing agent may be a multidentate complexing agent such as e.g., multidentate complexing agents, typically multidentate amines, and multidentate carboxylic acids and/or their salts. In some embodiments, suitable multidentate amines include ethylenediamine, diethylene-triamine, triethylenetetramine, or combinations thereof. In some embodiments, suitable multidentate carboxylic acids and/or their salts include citric acid, tartaric acid, oxalic acid, gluconic acid, nitriloacetic acid, or combinations thereof. In some embodiments, the complexing agent may be one or more amino acids such as, for example, glycine, lysine, and L-proline, or one or more common analytical chelating agents such as EDTA-ethylenediaminetetraacetic acid and its numerous analogs, and combinations thereof.

In some embodiments, the working fluid may contain an organic compound having both a carboxylic acid functional group and a second functional group selected from amines and halides. In some embodiments, the organic compound may comprise one or more of a variety of organic compounds having both a carboxylic acid functional group and a second functional group selected from amines and halides. In some embodiments, the second functional group is in the alpha position relative to the carboxylic acid functional group. In some embodiments, amino acids, including, e.g., alpha-amino acids (e.g., L-proline, glycine, alanine, arginine, and lysine), may be used. In some embodiments, the concentration of the organic compound in the working fluid is greater than about 0.1% by weight (e.g., greater than about 0.5% by weight). In some embodiments, the concentration of the organic compound in the working fluid is less than about 20% by weight (e.g., less than about 10% by weight).

In some embodiments, the working fluid contains oxidizing and/or bleaching agents such as, for example, transition metal complexes such as ferricyanide, ammonium ferric EDTA, ammonium ferric citrate, ferric citrate, ammonium ferric oxalate, cupric citrate, cupric oxalate, cupric gluconate, cupric glycinate, cupric tartrate, and the like.

In some embodiments, the concentration of the complexing agent in the working fluid is typically greater than about 0.01 by weight (e.g., at least about 0.02% by weight) In some embodiments, the concentration of the complexing agent in the working fluid is less than about 50% by weight (e.g., less than about 40% by weight). In some embodiments, complexing agents may be combined with oxidizing agents.

The pH of the liquid medium may affect performance, and is selected based upon the nature of the wafer surface being planarized, including the chemical composition and topography of the wafer surface. In some embodiments, buffers may be added to the working fluid to control the pH and thus mitigate pH changes from minor dilution from rinse water and/or difference in the pH of the deionized water depending on the source. In some embodiments, the buffer may include ammonium ion buffer systems based on the following protolytes, all of which have at least one pKa greater than 7: aspartic acid, glutamic acid, histidine, lysine, arginine, ornithine, cysteine, tyrosine, L-proline, and carnosine.

In some embodiments, e.g., where the wafer surface contains metal oxide (e.g., silicon dioxide), the working fluid may be an aqueous medium having a pH greater than about 5 (e.g., greater than about 6, or greater than about 10. In some embodiments, the pH is greater than about 10.5. In some embodiments, the pH is less than about 14.0 (e.g., less than about 12.5).

In some embodiments, the pH may be adjusted by including one or more hydroxide compounds such as, e.g., potassium hydroxide, sodium hydroxide, ammonium hydroxide, lithium hydroxide, magnesium hydroxide, calcium hydroxide, barium hydroxide, and basic compounds such as amines and the like, in the working fluid.

In some embodiments, the working fluid may contain additives such as surfactants, wetting agents, rust inhibitors, lubricants, soaps, and the like. These additives are chosen to provide the desired benefit without damaging the underlying semiconductor wafer surface. A lubricant, for example, may be included in the working fluid for the purpose of reducing friction between the abrasive article and the semiconductor wafer surface during planarization.

After modification of a substrate is complete, the substrate can be processed as desired, e.g., a semiconductor wafer is typically cleaned using procedures known in the art.

The following specific, but non-limiting, examples will serve to illustrate the invention. In these examples, all percentages are parts by weight unless otherwise indicated.

EXAMPLES

In Example 1, seven TEOS wafers (conventional blanket wafers) were polished on an OBSIDIAN FLATLAND 501, 200 millimeter polishing tool (available from Applied Materials, located in Santa Clara, Calif.). The wafer velocity was 600 mm/s. Each wafer was polished for 60 seconds with a wafer pressure (i.e., applied normal force) of 20.6 kPa (3 psi). A working fluid consisting of deionized water, adjusted to a pH of 10.5 with potassium hydroxide, and 2.5% by weight of a multidentate amino acid complexing agent as described in U.S. Pat. No. 6,194,317, was used as a working fluid. In this Example, the amino acid L-proline was used as the multidentate amino acid complexing agent.

A standard subpad, M6900 (available from 3M), was applied to the platen. The subpad comprised a rigid substrate and a resilient substrate. The rigid substrate was a 1.52 mm (60 mil) thick layer of polycarbonate. The resilient substrate was a 2.29 mm (90 mil) thick layer of closed-cell foam. This support assembly was modified by applying strips of 25.4 mm wide by 0.013 mm thick vinyl tape (3M VINYL TAPE 471, available from 3M) to the surface of the subpad, i.e., the tape was positioned between the rigid layer and the fixed abrasive article. The strips of tape were spaced 50 mm apart (i.e., the gap between adjacent strips of tape was 50 mm). The pieces of tape were applied perpendicular to the direction that the abrasive article was indexed.

The fixed abrasive article was M3152 (available from 3M). Prior to polishing any wafers, the fixed abrasive article was advanced to a section of the abrasive article that had not previously been used. The fixed abrasive article was indexed 6.35 mm (0.25 inch) after each wafer was polished.

All wafers were rinsed in deionized water after polishing and then dried with a simple spin drier. Film thickness measurements were made using an OPTIPROBE 2600 (available from Therma-Wave, Inc., located in Fremont, California) for each wafer before and after polishing. Cut rate was determined by difference in film thickness before and after polishing divided by the polishing time.

In Example 2, nine TEOS wafers were polished using the procedure of Example 1, except the strips of tape were spaced 76 mm apart.

In Comparative Example C1, nine TEOS wafers were polished using the procedure of Example 1, except the support assembly was unmodified, i.e., no tape strips were present in the support assembly.

In Example 3, ten TEOS wafers were polished using the procedure of Example 1, except the strips of tape were 19 mm wide (3M VINYL TAPE 471, available from 3M) and were spaced 13 mm apart. Also, the pH of the working fluid was adjusted to 11.2 and the amino acid was not included.

In Example 4, ten TEOS wafers were polished using the procedure of Example 3, except the strips of tape were spaced 6.4 mm apart.

In Example 5, ten TEOS wafers were polished using the procedure of Example 3, except that every fourth strip of tape was removed. This resulted in groups of three pieces of tape spaced 6.4 mm apart, with a gap of 31.8 mm between groups.

In Example 6, ten TEOS wafers were polished using the procedure of Example 3, except the strips of tape were spaced 57 mm apart.

In Example 7, nine TEOS wafers were polished using the procedure of Example 4, except two adjacent strips out of each group of four strips were removed. This resulted in groups of two pieces of tape spaced 6.4 mm apart, with a gap of 57 mm between groups.

In Example 8, ten TEOS wafers were polished using the procedure of Example 3, except the strips of tape were spaced 19 mm apart.

In Comparative Example C2, eleven TEOS wafers were polished using the procedure of Example 3, except that the support assembly was unmodified, i.e., no tape strips were present in the support assembly.

The average and standard deviation (Std. Dev.) for the cut rate obtained in Example 1–8 and Comparative Examples C1 and C2 are shown in Table 1.

TABLE 1

| | Cut Rate (Angstroms/minute) | |
|---|---|---|
| Example No. | Average | Std. Dev. |
| 1 | 622 | 68 |
| 2 | 990 | 75 |
| C1 | 610 | 101 |
| 3 | 565 | 163 |
| 4 | 736 | 246 |
| 5 | 1155 | 192 |
| 6 | 1563 | 58 |
| 7 | 1135 | 195 |
| 8 | 1062 | 121 |
| C2 | 483 | 185 |

The cut rate was higher when the multidentate amino acid complexing agent was present in the working fluid.

In Example 9, ten TEOS wafers were polished using the procedure of Example 6.

In Comparative Example C3, eleven TEOS wafers were polished using the procedure of Example 9, except the support assembly was unmodified, i.e., no tape strips were present in the support assembly.

In Example 10, ten TEOS wafers were polished using the procedure of Example 9, except fixed abrasive article SWR528-125/10 (available from 3M) was used.

In Comparative Example C4, twenty TEOS wafers were polished using the procedure of Example 10, except the support assembly was unmodified, i.e., no tape strips were present in the support assembly.

In Example 11, ten TEOS wafers were polished using the procedure of Example 9, except fixed abrasive article SWR540-125/10 (available from 3M) was used.

In Comparative Example C5, ten TEOS wafers were polished using the procedure of Example 11, except the support assembly was unmodified i.e., no tape strips were present in the support assembly.

The average and standard deviation (Std. Dev.) for the cut rate obtained in Examples 9–11 and Comparative Examples C3–C5 are shown in Table 2.

TABLE 2

| | Cut Rate (Angstroms/minute) | |
|---|---|---|
| Example No. | Average | Std. Dev. |
| 9 | 1563 | 58 |
| C3 | 483 | 63 |
| 10 | 1742 | 77 |
| C4 | 1025 | 162 |
| 11 | 1986 | 41 |
| C5 | 760 | 88 |

In Example 12, twenty TEOS wafers were polished according to the procedure of Example 3.

In Example 13, twenty TEOS wafers were polished according to the procedure of Example 3, except the tape was positioned between the platen and the resilient layer.

In Example 14, twenty TEOS wafers were polished according to the procedure of Example 3, except the tape was positioned between the rigid layer and the resilient layer.

In Comparative Example C6, 30 TEOS wafers were polished using the procedure of Comparative Example C2.

The average and standard deviation (Std. Dev.) for the cut rate obtained in Examples 12–14 and Comparative Example C6 are shown in Table 3.

TABLE 3

| | Cut Rate (Angstroms/minute) | |
|---|---|---|
| Example No. | Average | Std. Dev. |
| 12 | 1864 | 138 |
| 13 | 1303 | 169 |
| 14 | 1271 | 260 |
| C6 | 928 | 181 |

In Comparative Example C7, five TEOS wafers were polished using the procedure of Comparative Example C3, except the wafer pressure (i.e., applied normal force) was 35 kPa (5 psi). The average cut rate was 904 angstroms/minute with a standard deviation of 77.

In Comparative Example C8, five TEOS wafers were polished using the procedure of Comparative Example C6, except the support assembly was modified as follows. A second layer of M3152 was positioned between the subpad and the fixed abrasive article. The surface of M3152 is covered with evenly spaced, 200 um diameter, 40 um high round posts. The posts occupied ten percent of the surface area of the M3152. The average cut rate was 924 angstroms/minute with a standard deviation of 142.

Various modifications and alterations of this invention will become apparent to those skilled in the art without departing from the scope and spirit of this invention.

What is claimed is:

1. An apparatus for in situ activation of a three-dimensional fixed abrasive article comprising:

a) a three-dimensional fixed abrasive article comprising an abrasive surface and an opposing surface;

b) a substrate comprising a first surface, wherein the first surface of the substrate is adjacent the abrasive surface of the fixed abrasive article;

c) a support assembly, wherein the opposing surface of the fixed abrasive article is adjacent the support assembly; and d) an indexing mechanism, wherein the indexing mechanism advances the three-dimensional fixed abrasive article relative to the support assembly;

wherein, the support assembly is selected to create a region of a high erosion force at the abrasive surface of the fixed abrasive article and a region of a low erosion force at the abrasive surface of the fixed abrasive article when a normal force is applied to the substrate, the fixed abrasive article, and the support assembly creating a contact pressure between the first surface of the substrate and the abrasive surface of the fixed abrasive article, and a relative motion is created between the first surface of the substrate and the abrasive surface of the fixed abrasive article, wherein at least the high erosion force is sufficient to activate the fixed abrasive article, and wherein the low erosion force is less than the high erosion force.

2. The apparatus of claim 1, wherein the abrasive surface comprises a plurality of abrasive composites.

3. The apparatus of claim 1, wherein the support assembly comprises at least one spacer.

4. The apparatus of claim 1, wherein the support assembly comprises a platen, a resilient layer, and a rigid layer.

5. The apparatus of claim 4, wherein the support assembly further comprises at least one spacer interposed between at least one of:

a) the platen and the resilient layer;

b) the resilient layer and the rigid layer; and c) the rigid layer and the fixed abrasive article.

6. The apparatus of claim 4, wherein at least one of: the platen, the resilient layer, the rigid layer, and any layer positioned between the platen and the fixed abrasive article has a spatially modulated thickness.

7. The apparatus of claim 4, wherein at least one of: the platen, the resilient layer, the rigid layer and any layer positioned between the platen and the fixed abrasive article has a spatially modulated mechanical property.

8. The apparatus of claim 1, wherein the substrate comprises at least one of: a semiconductor wafer, a silicon wafer, glass, oxide, or ceramic.

9. The apparatus of claim 1, wherein the region of high erosion force comprises a first region of high erosion force and a second region of high erosion force separated by a gap, wherein the gap comprises a region of low erosion force.

10. The apparatus of claim 9, wherein the erosion force in the first region of high erosion force is substantially the same as the erosion force in the second region of high erosion force.

11. The apparatus of claim 9, wherein the gap is at least 6 about millimeters.

12. The apparatus of claim 9, wherein the gap is at least about 19 millimeters.

13. The apparatus of claim 1, wherein the indexing mechanism incrementally advances the three-dimensional fixed abrasive article relative to the support assembly.

14. The apparatus of claim 1, further comprising a working fluid present at an interface between the first surface of the substrate and the abrasive surface of the fixed abrasive article.

15. The apparatus of claim 14, wherein the working fluid comprises a complexing agent.

16. The apparatus of claim 15, wherein the complexing agent comprises a multidentate complexing agent.

17. The apparatus of claim 14, wherein the complexing agent is selected from the group consisting of: amino acids and chelating agents.

18. The apparatus of claim 14, wherein the working fluid comprises a buffer.

19. The apparatus of claim 14, wherein the working fluid comprises an organic compound comprising both a carboxylic acid functional group and a second functional group, wherein the second functional group is selected from then group consisting of: amines and halides.

20. An apparatus for the in situ activation of a three-dimensional fixed abrasive article comprising:

a) a three-dimensional fixed abrasive article comprising an abrasive surface and an opposing surface;

b) a substrate comprising a first surface, wherein the first surface of the substrate is adjacent the abrasive surface of the fixed abrasive article;

c) a support assembly; and d) a means for indexing the fixed abrasive article relative to the support assembly;

wherein, the support assembly comprises a means for creating a region of a high erosion force at the abrasive surface of the fixed abrasive article and a region of a low erosion force at the abrasive surface of the fixed abrasive article when a normal force is applied to the substrate, the fixed abrasive article, and the support assembly creating a contact pressure between the first surface of the substrate and the abrasive surface of the fixed abrasive article, and a relative motion is created between the first surface of the substrate and the abrasive surface of the fixed abrasive article wherein at least the high erosion force is sufficient to activate the fixed abrasive article, and wherein the low erosion force is less than the high erosion force.

21. The apparatus of claim 20, wherein the abrasive surface comprises a plurality of abrasive composites.

22. The apparatus of claim 20, further comprising at least one spacer.

23. The apparatus of claim 20, wherein the support assembly comprises a platen, a rigid layer, and a resilient layer.

24. The apparatus of claim 20, wherein the region of high erosion force comprises a first region of high erosion force and a second region of high erosion force separated by a gap, wherein the gap comprises a region of low erosion force.

25. The apparatus of claim 20, wherein the means for indexing the fixed abrasive article relative to the support assembly incrementally indexes the fixed abrasive article.

26. The apparatus of claim 20, farther comprising a working fluid present at an interface between the first surface of the substrate and the abrasive surface of the fixed abrasive article.

27. The apparatus of claim 26, wherein the working fluid comprises a complexing agent.

28. The apparatus of claim 27, wherein the complexing agent comprises a multidentate complexing agent.

29. The apparatus of claim 27, wherein the complexing agent is selected from the group consisting of: amino acids and chelating agents.

30. The apparatus of claim 26, wherein the working fluid comprises a buffer.

31. The apparatus of claim 26, wherein the working fluid comprises an organic compound comprising both a carboxylic acid functional group and a second functional group, wherein the second functional group is selected from then group consisting of: amines and halides.

32. The apparatus of claim 31, wherein the second functional group is in the alpha position relative to the carboxylic acid functional group.

33. The apparatus of claim 31, wherein the organic compound is selected from the group consisting of: L-proline, glycine, alanine, arginine, and lysine.

34. A method for the in situ activation of a three-dimensional fixed abrasive article comprising:

a) providing a substrate comprising a first surface;

b) providing a three-dimensional fixed abrasive article comprising an abrasive surface and an opposing surface;

c) contacting the opposing surface of the fixed abrasive article with a support assembly;

d) contacting the first surface of the substrate with a the abrasive surface of the fixed abrasive article;

e) creating a contact pressure between the abrasive surface of the fixed abrasive article and the first surface of the substrate by applying a normal force to the substrate, the fixed abrasive article and the support assembly;

f) providing a relative motion between the first surface of the substrate and the abrasive surface of the fixed abrasive article, wherein the applied normal force and the relative motion between the first surface of the substrate and the abrasive surface create an erosion force at the abrasive surface of the fixed abrasive article;

wherein, the support assembly is selected to create a region of a high erosion force and a region of a low erosion force, wherein at least the high erosion force is sufficient to activate the fixed abrasive article, and wherein the low erosion force is less than the high erosion force; and g) indexing the fixed abrasive article relative to the support assembly such that at least a portion of the abrasive composites move from the region of the high erosion force to the region of the low erosion force.

35. The method of claim 34, wherein the abrasive surface comprises a plurality of abrasive composites.

36. The method of claim 34, wherein indexing the fixed abrasive article relative to the support assembly comprises incrementally indexing the fixed abrasive article such that at least a portion of the abrasive composites move from the region of the high erosion force to the region of the low erosion force.

37. The method of claim 34, wherein the first surface of the substrate is modified by abrasive composites in region of the high erosion force and by abrasive composites in the region of the low erosion force.

38. The method of claim 34, wherein the support assembly comprises at least one spacer.

39. The method of claim 34, wherein the support assembly comprises a platen, a resilient layer and a rigid layer.

40. The method of claim 39, wherein the support assembly further comprises at least one spacer, and wherein the at least one spacer is interposed between at least one of:

a) the platen and the resilient layer;

b) the resilient layer and the rigid layer; and c) the rigid layer and the fixed abrasive article.

41. The method of claim 39, wherein at least one of: the platen, the resilient layer, the rigid layer and any layer positioned between the platen and the fixed abrasive article has a spatially modulated thickness.

42. The method of claim 39, wherein at least one of: the platen, the resilient layer, the rigid layer and any layer positioned between the platen and the fixed abrasive article has a spatially modulated mechanical property.

43. The method of claim 34, wherein the substrate comprises at least one of: a semiconductor wafer, a silicon wafer, glass, oxide, or ceramic.

44. The method of claim 34, wherein the region of high erosion force comprises a first region of high erosion force and a second region of high erosion force separated by a gap, wherein the gap comprises a region of low erosion force.

45. The method of claim 44, wherein the erosion force in the first region of high erosion force is substantially the same as the erosion force in the second region of high erosion force.

46. The method of claim 44, wherein the gap is at least about 6 millimeters wide.

47. The method of claim 44, wherein the gap is at least about 19 millimeters wide.

48. The method of claim 34, further comprising supplying a working fluid to an interface between the first surface of the substrate and the abrasive surface of the fixed abrasive article.

49. The method of claim 48, wherein the working fluid comprises a complexing agent.

50. The method of claim 49, wherein the complexing agent comprises a multidentate complexing agent.

51. The method of claim 49, wherein the complexing agent is selected from the group consisting of: amino acids and chelating agents.

52. The method of claim 48, wherein the working fluid comprises a buffer.

53. The method of claim 48, wherein the working fluid comprises an organic compound comprising both a carboxylic acid functional group and a second functional group, wherein the second functional group is selected from then group consisting of: amines and halides.

54. The method of claim 53, wherein the second functional group is in the alpha position relative to the carboxylic acid functional group.

55. The method of claim 53, wherein the organic compound is selected from the group consisting of: L-proline, glycine, alanine, arginine, and lysine.

56. The apparatus of claim 19, wherein the second functional group is in the alpha position relative to the carboxylic acid functional group.

57. The apparatus of claim 19, wherein the organic compound is selected from the group consisting of: L-proline, glycine, alanine, arginine, and lysine.

* * * * *

UNITED STATES PATENT AND TRADEMARK OFFICE

CERTIFICATE OF CORRECTION

PATENT NO. : 7,160,178 B2
APPLICATION NO. : 10/636792
DATED : January 9, 2007
INVENTOR(S) : John J. Gagliardi It is certified that error appears in the above-identified patent and that said Letters Patent is hereby corrected as shown below:

On the First Page, in Column 2, under (U.S. Patent Documents)
Line 15, after "6,325,702" delete "B1" and insert -- B2 --, therefor.

On Page 2, in Column 1, under (U.S. Patent Documents)
Line 1, after "6,361,423" delete "B1" and insert -- B2 --, therefor.
Line 9, after "6,530,824" delete "B1" and insert -- B2 --, therefor.
Line 11, after "6,575,825" delete "B1" and insert -- B2 --, therefor.
Line 12, after "6,592,438" delete "B1" and insert -- B2 --, therefor.
Line 13, after "6,612,917" delete "B1" and insert -- B2 --, therefor.
Line 14, after "6,632,129" delete "B1" and insert -- B2 --, therefor.
Line 15, after "6,648,731" delete "B1" and insert -- B2 --, therefor.
Line 16, after "6,712,679" delete "B1" and insert -- B2 --, therefor.

Column 14
Line 9, delete "shwon" and insert -- shown --, therefor.

Column 17
Line 29, after "weight)" insert -- . --.
Line 49, delete "10." and insert -- 10). --, therefor.

Column 19
Line 19, delete "Example" and insert -- Examples --, therefor.

Column 21
Line 51, in Claim 11, delete "6 about" and insert -- about 6 --, therefor.

Column 22
Line 47, in Claim 26, delete "farther" and insert -- further --, therefor.
Line 63, in Claim 31, delete "then" and insert -- the --, therefor.

Column 23
Line 12, in Claim 34, delete "a the" and insert -- the --, therefor.

UNITED STATES PATENT AND TRADEMARK OFFICE

CERTIFICATE OF CORRECTION

PATENT NO. : 7,160,178 B2
APPLICATION NO. : 10/636792
DATED : January 9, 2007
INVENTOR(S) : John J. Gagliardi It is certified that error appears in the above-identified patent and that said Letters Patent is hereby corrected as shown below:

Column 24
Line 40, in Claim 53, delete "then" and insert -- the --, therefor.

Signed and Sealed this

Second Day of September, 2008

JON W. DUDAS
*Director of the United States Patent and Trademark Office*